United States Patent [19]

Habermann et al.

[11] Patent Number: 4,668,347

[45] Date of Patent: May 26, 1987

[54] ANTICORROSIVE COATED RECTIFIER METALS AND THEIR ALLOYS

[75] Inventors: Clarence E. Habermann; David S. Garrett, both of Midland, Mich.

[73] Assignee: The Dow Chemical Company, Midland, Mich.

[21] Appl. No.: 804,721

[22] Filed: Dec. 5, 1985

[51] Int. Cl.[4] ..... C25D 5/44

[52] U.S. Cl. ..... 204/33; 204/32.1; 204/56.1; 204/58; 204/58.4

[58] Field of Search ..... 204/58, 58.4, 56.1, 204/32.1, 33, 56 M

[56] References Cited

U.S. PATENT DOCUMENTS

| | | | |
|---|---|---|---|
| 2,880,148 | 3/1959 | Evangelides | 204/35 |
| 3,834,999 | 9/1974 | Hradcovsky et al. | 204/58.4 |
| 3,956,080 | 5/1976 | Hradcovsky et al. | 204/58.4 |
| 4,184,926 | 1/1980 | Kozak | 204/58.4 |

FOREIGN PATENT DOCUMENTS

| | | | |
|---|---|---|---|
| 543726 | 3/1942 | United Kingdom | 204/56 M |

OTHER PUBLICATIONS

Chemical Abstracts, vol. 75, 1971 p. 422 104365n Anodizing in Fluoroboric Acid solutions.

*Primary Examiner*—R. L. Andrews

[57] ABSTRACT

Metals and alloys of metals which have the property of electrolytic rectification can be coated with an anticorrosive coating by immersion in a strongly alkaline aqueous bath comprising a water soluble fluoride, a water soluble iron salt, and mixtures thereof by the application of a sufficiently high voltage to obtain spark discharge at the surface to be coated, said potential being applied between the metal or alloy to be coated utilized as an anode and a cathode immersed in the aqueous bath. A durable coating is thereby applied to the surface of said metals or alloys thereof which is resistant to a corrosive salt spray environment.

15 Claims, No Drawings

ANTICORROSIVE COATED RECTIFIER METALS AND THEIR ALLOYS

BACKGROUND OF THE INVENTION

1. Field of the Invention

This invention relates to an electrolytic process for the formation of a hard, protective film on the surface of a rectifier metal or alloy thereof.

2. Description of the Prior Art

One of the primary problems associated with the extensive use of magnesium and aluminum is the tendency of these metals to corrode especially when exposed to an environment where an alkali metal halide such as sodium chloride is present alone or in combination with water. A well known process for providing a protective coating for aluminum is the process of anodization. This process has been used to a limited extent with magnesium but the coatings obtained are not highly resistant to attack by corrosive agents such as acids or alkalis, particularly aqueous sodium chloride.

A process is disclosed for anodizing, in fluoroboric acid solutions, aluminum and alloys of aluminum, as described in Chemical Abstracts 75:104365n. A solution containing 0.1 to 2.5% fluoroboric acid was utilized to anodize aluminum and aluminum alloys at a temperature of 0° to 30° Centigrade. A film of high breakdown voltage/thickness ratio was obtained on aluminum indicating a film of compact structure similar in nature to a barrier film. Increased anodizing temperature had an effect similar to higher concentration and increased the deposition of the oxide film. The behavior of the coated aluminum alloys was less satisfactory than the pure metal in resisting corrosion under salt fog conditions.

In U.S. Pat. No. 3,834,999 there is disclosed the electrolytic production of glassy layers on metals and alloys in order to improve corrosion resistance of said metals and alloys wherein the layers are applied by the anodization of the metals and their alloys in anodization baths containing anions such as tungstate, phosphate, arsenate, stannate, molybdate, borate, chromate, and dichromate. The minimum voltage disclosed as useful in the electrolytic anodization of metals or their alloys is about 600 volts.

In U.S. Pat. No. 4,184,926, there is disclosed an anticorrosive coating for magnesium and its alloys which is capable of withstanding the action of strong acids and alkalis prepared by first treating the metal or the alloy thereof with an aqueous solution of hydrofluoric acid to form a fluoromagnesium first layer on the metal surface. After rinsing off the hydrofluoric acid, the metal or alloy is immersed in an electrolytic bath containing an aqueous solution of an alkali metal silicate and an electrical potential is applied between the metal as an anode and a cathode, also immersed in the bath, in order to apply a uniform silicate layer over the first layer on the metal.

In U.S. Pat. No. 3,956,080, there is disclosed a process for coating a rectifier metal such as aluminum or magnesium, said coating being resistant to attack by chemical agents. The protective coating is applied by immersing the metal in a bath containing an alkali metal silicate and applying an electrical potential between the metal, utilized as an anode, and a cathode also immersed in the bath. This reference teaches away from the use of such undesirable ions as bromide, fluoride, iodide, chloride, sulphate, nitrate, and cyanide to form the protective coating.

SUMMARY OF THE INVENTION

A rectifier metal article or alloy thereof can be coated with a corrosion resistant fluoride or iron containing coating by an electrolytic process utilizing a strongly alkaline aqueous bath comprising at least one water soluble fluoride or iron salt or mixture thereof. The coating is applied by establishing a potential difference of at least about 50 volts between said rectifier metal or alloy theof as an anode immersed in said bath and a cathode also immersed in said bath. The coatings are resistant to the corrosive effects of acids and alkalis, particularly the corrosive effects of aqueous sodium chloride. Improved anticorrosive coatings are obtained when an aqueous hydrofluoric acid pretreatment is utilized prior to coating the rectifier metal or alloy thereof with the water soluble fluoride or iron salt.

DETAILED DESCRIPTION OF THE INVENTION

A corrosion resistant, hard, uniform adherent coating can be applied to a rectifier metal or alloy thereof by immersing the metal in an electrolytic cell bath containing a water soluble fluoride or iron salt or mixture thereof and establishing a potential difference of at least about 50 volts between said rectifier metal or alloy thereof as an anode and a cathode immersed in said bath. The bath is made strongly alkaline by incorporating therein an alkali metal hydroxide.

Those metals that exhibit an electrolytic rectifier effect can be coated according to the invention. The term "metal" is used herein to mean elemental metals and their alloys and those metals and alloys having a property of electrolytic rectification are termed "rectifier metals" herein. Such rectifier metals have the property of passing electrical current when they are made the negative electrode (cathode) in an electrolytic cell and of presenting a high resistance and greatly limiting current flow when these metals are made the positive electrode (anode) in an electrolytic cell. This high resistance to electric current flow when the metal is used as the anode is apparently due to the formation of a high electrical resistance zone or coating at or on the surface of the metal. Since this property has been used to provide rectification of alternating current to afford direct current, metals exhibiting this effect have been referred to in the art as rectifier metals.

The property of passing current preferentially in one direction in electrolytic cell baths is exhibited by such metals as aluminum, beryllium, magnesium, tantalum, tellurium, silicon, germanium, titanium, niobium, and calcium, all of which can be effectively coated in accordance with the process of the invention. The alloys of the rectifier metals as well as the pure or commercially pure rectifier metals can also be coated in accordance with the process of the invention. For example, a wide variety of aluminum alloys can be coated. Those skilled in the art will appreciate that the rectifier metal can be in the form of castings, ingot, rolled or extruded sheet, tubing and other forms used in producing articles. A nonrectifier metal coated with, bonded to or otherwise covered with a suitable rectifier metal can also be treated to form a durable coating on the rectifier metal portion of the assembly in accordance with the process of the invention.

In order to form the coating on the rectifier metal, this metal is made the anode in an electrolytic cell so that the metal itself is at a positive potential. Improved anticorrosive coatings are obtained when an aqueous hydrofluoric acid pretreatment is utilized prior to coating the rectifier metal or alloy thereof with the water soluble fluoride or iron salt. The cathode of the electrolytic cell can be any suitable material which will not substantially dissolve in, react with or otherwise interfere with the deposition of the surface coating on the rectifier metal anode. Such cathode materials include iron, stainless steel, nickel, graphite, or other conducting forms of carbon and mixtures containing conductive carbon, magnesium, chromium, silicon, mercury, sodium-mercury amalgam, platinum, gold, rhodium, silver, palladium, iridium, osmium, cobalt, and the like. Certain types of cathodes can also be enclosed in permeable glass or other poorly conductive material. Preferred cathode materials for use herein are iron and stainless steel. One skilled in the art will appreciate that the cathode of the electrolytic cell need not be in the form of an electrode element immersed in the electrolyte bath but can in fact comprise the container for the electrolyte bath. Similarly the rectifier metal can be utilized as the container for the electrolyte and a cathode in the form of a rod, bar, sheet, grid, or other suitable form of metal can be dipped into the electrolyte bath.

It should be noted that a high voltage difference is utilized in the electrolytic cell in the process of coating a rectifier metal, the cathode being made of a different metal from that of the metal to be coated. The electrical potential difference in current density applied to cause deposition of a protective coating in accordance with the invention can vary according to factors such as composition of the electrolyte bath, the rectifier metal, the type of coating desired, and the like. Generally, the anode and cathode are connected to an electrical power source and the voltage across the bath is gradually increased until a spark discharge occurs at the anode surface. The voltage is further increased until a coating of the desired thickness has formed. Alternating current can be used because of the rectification effect of the rectifier metal anode. Use of direct current is preferred. When the potential difference reaches or exceeds about 50 volts, a spark discharge occurs.

To form the corrosion resistant layer on a rectifier metal substrate of the invention, the voltage is applied starting at a low value and gradually increased. Initially, the recifier metal is oxidized but when the voltage reaches about 50 volts deposition of the coating starts. As the voltage is increased, further spark discharges appear on the surface of the rectifier metal anode. The temperature of the spark discharges may be as high as 1,500° centigrade. It is believed that the high temperature resulting from the discharge melts the coating being applied to the rectifier metal surface and insures that a homogeneous, pore free coating on the surface of the metal is formed. The thickness of the coated layer depends upon the current density, the duration of the coating process and the concentration of the electrolyte bath.

The oxidation of the surface of the rectifier metal reaches a maximum generally within a few seconds from the initial immersion of the rectifier metal in the bath and the establishment of the potential difference of at least 50 volts between said rectifier metal and the cathode in the electrolyte bath. The voltage must then be increased in order to maintain a flow of current and efficient deposition of the anticorrosive coating of the invention. Depending upon the length of time utilized to deposit the coating on the rectifier metal and upon the voltage used for the deposition, anticorrosive layers up to about 2 millimeters in thickness can be readily achieved. A coating thickness of about 0.001 millimeter to about 2 millimeters provides suitable anticorrosion properties when the coated rectifier metal is exposed to a salt spray environment.

In applying a coating to a rectifier metal in accordance with the process of the invention, the current density is generally held in a range of about 250 to about 500 milliamps per square centimeter by adjustment of the voltage. To prepare a satisfactory coating the voltage may need to be raised to at least about 500 volts and may go as high as about 1,000 volts. At the higher end of the voltage range, the surface of the coating can become rough. In any case the coating does not become porous.

The optimum electrolytic cell bath temperature for coating a rectifier metal in accordance with the process of the invention is about 30° to about 90° centigrade, preferably about 50° to about 60° degrees centigrade. Since substantial amounts of heat can be generated by the process it may be necessary, if the anode is large in size, to use auxiliary means of cooling the bath.

After the voltage is applied during the coating process of the invention so as to obtain spark discharge and the coating has been formed on the rectifier metal, the power is maintained until the desired coating thickness is formed. Then the power is removed from the anode and the cathode and the coated rectifier metal anode is removed from the bath. Generally the coated rectifier metal is rinsed to remove the highly alkaline electrolytic bath liquid from the surface of the coated metal. The rinsing can take place utilizing plain water. The components of the electrolytic bath include an alkali metal hydroxide generally in the amount of at least about 5 grams per liter but amounts of alkali metal hydroxide up to the saturation level can be used such as up to about 100 grams per liter of alkali metal hydroxide. The preferred alkali metal hydroxide is sodium or potassium hydroxide. Preferred alkali metal hydroxide concentrations for use in the process of the invention are from about 5 grams per liter to about 50 grams per liter.

The strongly alkaline electrolytic cell bath utilized in the coating process of the invention also contains a water soluble fluoride or a water soluble iron salt. The alkali metal hydroxide besides providing an electrolyte functions to provide increased hardness in the coating applied to the rectifier metal. Thus, the use of an increased amount of alkali metal hydroxide in the bath is generally believed to result in an increase of the hardness of the coating applied to the rectifier metal.

The concentration of the water soluble fluoride or water soluble iron salts in said electrolytic cell generally can be about 5 to about 150 grams per liter. Preferably about 10 to about 100 grams per liter is used providing the water soluble salts have solubilities at the higher portions of these ranges. Examples of useful water soluble fluoride salts are the ammonium and the alkali metal fluoroborates, the ammonium and the alkali metal fluoroaluminates, the ammonium and the alkali metal fluosilicates, and mixtures thereof. Examples of useful iron salts are the ammonium or the alkali metal iron cyanides and the ammonium or the alkali metal iron oxalates, and mixtures thereof.

Variations in color as well as other properties of the coating can be provided by the addition of small quantities of other compounds to the electrolytic bath. Compounds which provide anions capable of changing the color of the coating are those compounds of vanadium, arsenic, boron, chromium, titanium, tin, antimony, tungsten, molybdenum or combinations thereof preferably in the form of the alkali metal salts. These compounds are useful in amounts of up to about 50 grams per liter.

Alternatively, said rectifier metal or alloy thereof can be pretreated prior to coating by electrochemical means with an aqueous solution of hydrofluoric acid or an aqueous solution of a fluoride salt. Ammonium fluoride, ammonium bifluoride and the alkali metal fluoride and bifluoride salts are useful.

In order to evaluate the anticorrosive protective action of the coated rectifier metal prepared in accordance with the process of the invention, panels of a magnesium alloy having the composition magnesium 90, aluminum 9, and zinc 1 were coated with various fluoride containing or iron containing coatings. Generally a coating layer of about 0.001 millimeter to about 2 millimeters was utilized. The panels were tested by exposure to an aqueous solution of sodium chloride having a concentration of 5% by weight sodium chloride in accordance with standard test procedure ASTM B-117-73 in which a spray of said sodium chloride aqueous solution is applied at 95° F. to the panel and the sample is evaluated for the percent corrosion at regular intervals.

The following examples illustrate the various aspects of the invention but are not intended to limit its scope. Where not otherwise specified throughout this specification and claims, temperatures are given in degrees centigrade, and parts, percentages, and proportions are by weight.

EXAMPLE 1 (CONTROL, FORMING NO PART OF THIS INVENTION)

As a basis for comparision of the coatings applied in accordance with the process of the invention, a panel of magnesium alloy (magnesium 90, aluminum 9, zinc 1) coated with a commercial chromate type corrosion resistance coating was tested in a salt spray environment over a period of seven days (168 hours) and was found to show 5 to 10% corrosion evenly distributed over the surface of the sample.

EXAMPLE 2 (CONTROL, FORMING NO PART OF THIS INVENTION)

In order to illustrate the type of coating obtained when anodizing a magnesium alloy in the presence of an aluminate ion a 1.5 inch by 4 inch panel of a magnesium alloy having the composition magnesium 90, aluminum 9, and zinc 1 was polished with No. 1 grit sandpaper and rinsed with acetone thereafter. This panel was spark anodized in an electrolytic bath, the magnesium alloy panel formed the anode in the electrolytic cell and an iron cathode was used as the cathode of the cell. The electrolytic bath contained a solution of sodium hydroxide at a concentration of 40 grams per liter and a solution of sodium aluminate, $Na_2Al_2O_4.3H_2O$. The potential applied across the cell varied from 70 to 100 volts and 0 to 15 amperes for a period of 10 minutes during which time the coating was applied. A gray, partially crystalline coating was formed on the magnesium alloy. After one week of exposure to aqueous salt spray testing the coated magnesium panel was corroded to the estent of about 20% upon exposure at 5% by weight sodium chloride and 95° F.

EXAMPLE 3

A 1.5 inch by 4 inch panel of magnesium alloy having the composition magnesium 90, aluminum 9, and zinc 1 was sanded utilizing No. 1 grit sandpaper and thereafter rinsed with acetone. The panel was made an anode in an electrolytic cell having an iron cathode and an electrolytic solution containing 40 grams per liter of sodium hydroxide, 20 grams per liter of sodium fluosilicate and 20 grams per liter of sodium silicate ($Na_2SiO_3.9H_2O$). The applied potential was 70 volts at 15 amperes over a period of 12 minutes during which time the coating was applied by spark anodization to the magnesium alloy panel. A uniform gray coating was obtained which after rinsing in plain water was tested for corrosion tendency in a salt spray chamber containing a 5% by weight aqueous solution of sodium chloride at a temperature of 95° Fahrenheit. Exposure in the salt spray chamber for a period of 1,484 hours resulted in 2% corrosion of the sample. After a total of 3,500 hours the sample showed 10% pitting corrosion.

EXAMPLE 4

Utilizing a similarly treated panel of the same magnesium alloy as used in Example 3, the panel before spark anodizing was pretreated by dipping into 10% aqueous solution of hydrofluoric acid for a period of 2 minutes. Thereafter spark anodization of the panel was carried out utilizing an electrolytic bath solution containing 80 grams per liter of sodium hydroxide and 30 grams per liter of sodium fluosilicate. The coating was applied utilizing a potential of 65 volts and 15 amperes for a period of 14 minutes. It is noted that the amperes descreased to zero over this period. A hard white somewhat uneven coating was obtained which after rinsing was exposed in a salt spray chamber, as described above, for a period of 989 hours. The sample after this time exhibited only 0.5% corrosion. After a total of 2,455 hours the sample showed about 35% corrosion.

EXAMPLE 5

Utilizing the same pretreatment in hydrofluoric acid as described in Example 4 and the same magnesium alloy, spark anodization was carried out to apply a coating to the magnesium alloy panel utilizing an electrolytic path containing 30 grams per liter of sodium fluosilicate, 40 grams per liter of diethylene glycol, and 40 grams per liter of sodium hydroxide. The cathode utilized was of iron. The potential applied was 240 volts at 4 to 6 amperes. This potential did not produce visible sparking but a smooth, white, tough and dense coating was obtained which after rinsing in plain water was exposed to a salt spray chamber, as described above, and found to show less than 0.5% corrosion after a period of 499 hours and after a period of 2,510 hours, less than 10% corrosion was exhibited.

EXAMPLE 6

Utilizing the same magnesium alloy, the same pretreatment in hydrofluoric acid, as shown in Example 4, and the same composition of electrolyte bath, the magnesium panel was coated at a potential of 280 volts and 4 to 6 amperes. After rinsing in plain water the coated magnesium alloy was pressed in a hydraulic press at a pressure of $10^5$ pounds per square inch in order to compress and smooth the coating surface. Upon exposure to the salt spray chamber containing 5% sodium chloride at a temperature of 95° Fahrenheit, it was noted that after a period of 499 hours, the sample showed less than 0.5 percent corrosion and after 2,510 hours in the salt spray chamber the sample showed less than 10% corrosion.

EXAMPLE 7

Utilizing the same magnesium alloy and the same pretreatment in hydrofluoric acid, as shown in Example 4, a magnesium alloy panel was spark anodized in an electrolyte solution containing 25 grams per liter of sodium aluminate, 25 grams per liter of sodium fluoroaluminate, 16.1 grams per liter of potassium hydroxide, and 62.5 milliliters per liter of diethylene glycol. The spark anodization was carried out utilizing a potential of 320 volts at 4 to 5 amperes over a period of 1 to 2 minutes. After rinsing in plain water the coated sample was subjected to the salt spray chamber, as described above, and found to show 2 to 3% corrosion after a period of 1,816 hours. After a total of 3,864 hours, the coated surface was less than 10% pitted.

EXAMPLE 8

Utilizing the same magnesium alloy and the same pretreatment in an aqueous hydrofluoric acid solution, as disclosed in Example 4, a magnesium alloy panel was spark anodized in an electrolyte containing 27.5 grams per liter of sodium fluoroborate, 80 grams per liter of sodium hydroxide, and 6 grams per liter of potassium ferricyanide $K_4Fe(CN)_6$. The coating process was carried out utilizing a potential of 5 to 65 volts and 15 amperes over a period of 8 minutes. The surface showed a finely fused, thin surface coating having a greenish tinge. After rinsing in plain water the coated panel was exposed to salt spray testing, as described above. After 167 hours in the salt spray chamber, the coated surface showed no corrosion. After 1,456 hours in the salt spray chamber the coated panel showed 15% corrosion.

EXAMPLE 9

Utilizing the same magnesium alloy and the same pretreatment with a solution of hydrofluoric acid, as described in Example 4, the magnesium panel was spark anodized utilizing an electrolyte containing 27.5 grams per liter of sodium fluoroborate, 25 grams per liter of potassium hydroxide, and 80 grams per liter of sodium hydroxide. Spark anodization was carried out at a potential of 55 to 60 volts and 5 to 7 amperes over a period of 8 minutes. Thereafter a potential of 62 volts and 10 to 13 amperes were applied over a period of 3 minutes. The appearance of the coating was white, uniform and tough. After rinsing the coating in plain water the coated magnesium panel was exposed to testing in the salt spray chamber, as described above, for a period of 167 hours. Evaluation thereafter showed no surface corrosion. After a total of 2,180 hours the sample showed less than 10% corrosion.

EXAMPLE 10

Utilizing the same magnesium alloy and the same pretreatment in an aqueous solution of hydrofluoric acid, as described in Example 4, a magnesium alloy panel was spark anodized utilizing an elecolyte solution containing 35.9 grams per liter of $Na_3Fe(C_2O_4)$, 40 grams per liter of potassium hydroxide and 5 grams per liter of sodium fluoroaluminate. The potential applied to form a coating was 85 volts and 4 to 8 amperes over a period of 5 minutes. After rinsing the sample in plain water it was exposed to the salt spray chamber, as described above, for a period of 167 hours after which it was noted that less than 0.5% of the coated sample showed corrosion. After a total of 3,360 hours the coated sample showed about 20% corrosion.

While this invention has been described with reference to certain specific embodiments, it will be recognized by those skilled in the art that many variations are possible without departing from the scope and spirit of the invention, and it will be understood that it is intended to cover all changes and modifications of the invention disclosed herein for the purposes of illustration which do not constitute departures from the spirit and scope of the invention.

The embodiments of the invention in which an exclusive property or priviledge is claimed are defined as follows:

1. An article consisting of a rectifier metal or alloy thereof coated with at least one anticorrosive coating by the process comprising:

(a) immersing said rectifier metal or alloy thereof in a strongly alkaline aqueous bath comprising at least one water soluble iron salt selected from the group consisting of at least one of the water soluble fluoroborates, fluorosilicates, and fluoroaluminates, and (b) establishing a potential difference of at least 50 volts between said rectifier metal article or alloy thereof as an anode and a cathode in said bath to deposit said coating on said metal or alloy thereof.

2. An article according to claim 1 wherein the thickness of said anticorrosive coating is about 0.001 millimeter to about 2 millimeters.

3. An article according to claim 1 wherein the rectifier metal or alloy thereof is selected from the group consisting of aluminum and its alloys, beryllium and its alloys, magnesium and its alloys, tantalum and its alloys, tellurium and its alloys, silicon and its alloys, germanium and its alloys, titanium and its alloys, niobium and its alloys, calcium and its alloys and mixtures thereof.

4. An article according to claim 1 wherein the rectifier metal or alloy thereof is selected from the group consisting of magnesium and its alloys and aluminum and its alloys, said aqueous bath is maintained at a temperature of about 30° to about 90° centigrade, and said rectifier metal or alloy thereof is pretreated prior to coating by contacting an aqueous solution comprising hydrofluoric acid or an aqueous solution comprising a fluoride salt.

5. An article according to claim 4 wherein said rectifier metal alloy is a magnesium based alloy consisting of magnesium 90, aluminum 9, and zinc 1 and said water soluble salt is selected from the group consisting of ammonium and alkali metal fluoroborates, ammonium and alkali metal fluoroaluminates, ammonium and alkali metal fluorosilicates, and mixtures thereof.

6. The article of claim 4 wherein said rectifier metal alloy is a magnesium based alloy consisting of magnesium 90, aluminum 9, and zinc 1 and said water soluble iron salt is selected from the group consisting of ammonium or alkali metal ion cyanides, ammonium or alkali metal iron oxalates, and mixtures thereof.

7. A process of applying to a rectifier metal or alloy thereof at least one coating having improved resistance to corrosion by exposure to aqueous sodium chloride, said process comprising:

(a) contacting said rectifier metal or alloy thereof with a strongly alkaline aqueous bath comprising at least one water soluble iron salt or at least one salt selected from the group consisting of water soluble fluoroborates, fluorosilicates, and fluoroaluminates, (b) applying an electrical potential of about 50 to about 1,000 volts between said metal utilized as an anode immersed in said aqueous bath and a cathode immersed in said aqueous bath, said electrical potential being maintained until the desired coating thickness is formed on said metal.

8. The process of claim 7 wherein said rectifier metal or alloy thereof is a metal or alloy thereof selected from at least one of the metals consisting of aluminum, beryllium, magnesium, tantalum, tellurium, silicon, germanium, titanium, niobium, or calcium and said bath is maintained at a temperature of about 30° to about 90° centigrade.

9. The process of claim 7 wherein said rectifier metal or alloy thereof is selected from the group consisting of magnesium, aluminum, and their alloys and said aqueous bath contains about 5 to about 150 grams per liter of said water soluble salt or mixtures thereof.

10. The process of claim 9 wherein said electrical potential is a direct current potential.

11. The process of claim 10 wherein said aqueous bath is made strongly alkaline utilizing an alkali metal hydroxide, said bath is maintained at a temperature of about 50° to about 60° centigrade, and said metal or alloy thereof is pretreated prior to coating by contacting an aqueous solution comprising hydrofluoric acid or contacting an aqueous solution comprising a fluoride salt.

12. The process of claim 11 wherein said cathode is selected from the group consisting of iron and stainless steel.

13. The process of claim 12 wherein said rectifier metal alloy is a magnesium based alloy consisting of magnesium 90, aluminum 9, and zinc 1 and said water soluble salt is selected from the group consisting of ammonium and alkali metal fluoroborates, ammonium and alkali metal fluoroaluminates, ammonium and alkali metal fluorosilicates, and mixtures thereof.

14. The process of claim 12 wherein said rectifier metal alloy is a magnesium based alloy consisting of magnesium 90, aluminum 9, and zinc 1 and said water soluble iron salt is selected from the group consisting of an ammonium or an alkali metal iron cyanide, an ammonium or an alkali metal iron oxalate, and mixtures thereof.

15. The process of claim 14 wherein said alkali metal hydroxide is selected from the group consisting of sodium hydroxide, potassium hydroxide, and mixtures thereof.

* * * * *

UNITED STATES PATENT AND TRADEMARK OFFICE

CERTIFICATE OF CORRECTION

PATENT NO. : 4,668,347

DATED : May 26, 1987

INVENTOR(S) : Clarence E. Habermann and David S. Garrett

It is certified that error appears in the above-identified patent and that said Letters Patent is hereby corrected as shown below:

Col. 2, line 12; change "theof" to --thereof--.

Col. 6, line 1; change "estent" to --extent--.

Col. 6, line 49; change "path" to --bath--.

Col. 7, line 65; change "elecolyte" to --electrolyte--.

Col. 8, line 25, Claim 1; insert --or a salt-- before "selected".

Col. 8, line 63, Claim 6; change "ion" to --iron--.

Signed and Sealed this

Twenty-sixth Day of January, 1988

*Attest:*

DONALD J. QUIGG

*Attesting Officer*

*Commissioner of Patents and Trademarks*